US009181665B2

(12) United States Patent
Stephens et al.

(10) Patent No.: US 9,181,665 B2
(45) Date of Patent: Nov. 10, 2015

(54) BARRIER SYSTEM AND CONNECTOR

(71) Applicant: TRINITY HIGHWAY PRODUCTS, LLC, Dallas, TX (US)

(72) Inventors: Barry D. Stephens, Roseville, CA (US); James B. Welch, Placerville, CA (US)

(73) Assignee: Trinity Highway Products, LLC, Dallas, TX (US)

( * ) Notice: Subject to any disclaimer, the term of this patent is extended or adjusted under 35 U.S.C. 154(b) by 0 days.

(21) Appl. No.: 14/209,669

(22) Filed: Mar. 13, 2014

(65) Prior Publication Data

US 2014/0314479 A1 Oct. 23, 2014

Related U.S. Application Data

(60) Provisional application No. 61/791,675, filed on Mar. 15, 2013.

(51) Int. Cl.
*E01F 15/00* (2006.01)
*E01F 15/08* (2006.01)

(52) U.S. Cl.
CPC ..... *E01F 15/088* (2013.01); *E01F 15/086* (2013.01)

(58) Field of Classification Search
CPC ..... E01F 15/088; E01F 13/00
USPC ..... 404/6, 72, 73; 256/1, 13.1
See application file for complete search history.

(56) References Cited

U.S. PATENT DOCUMENTS

| | | | | |
|---|---|---|---|---|
| 5,425,594 | A | 6/1995 | Krage et al. | |
| 5,494,371 | A * | 2/1996 | Oberth et al. | 404/6 |
| 6,428,237 | B1 | 8/2002 | Duckett | |
| 6,485,224 | B1 * | 11/2002 | Dyke et al. | 404/6 |
| 6,863,468 | B2 | 3/2005 | Davis et al. | |
| 7,226,236 | B2 * | 6/2007 | Mertens | 404/6 |
| 8,647,012 | B2 * | 2/2014 | Wilkinson et al. | 404/6 |
| 8,864,108 | B2 * | 10/2014 | James | 256/19 |
| 2002/0025221 | A1 * | 2/2002 | Johnson | 404/6 |
| 2007/0206990 | A1 * | 9/2007 | Yodock et al. | 404/6 |
| 2007/0243015 | A1 | 10/2007 | Yodock et al. | |
| 2010/0215427 | A1 | 8/2010 | James | |
| 2012/0207541 | A1 | 8/2012 | Maus et al. | |

FOREIGN PATENT DOCUMENTS

DE 4038538 * 6/1992 ..... E01F 15/00

OTHER PUBLICATIONS

International Search Report issued in PCT Patent Application No. PCT/US2014/025709, mailed Jul. 14, 2014, 2 pages.

* cited by examiner

*Primary Examiner* — Raymond W Addie
(74) *Attorney, Agent, or Firm* — Brinks Gilson & Lione

(57) ABSTRACT

A barrier system includes a plurality of elongated barriers each having longitudinally spaced ends, each configured with a connector having a pair of laterally spaced openings. The barriers are arranged in an end-to-end configuration, wherein at least two adjacent barriers are arranged with both of the pairs of openings of adjacent connectors being aligned. In one embodiment, at least two other adjacent barriers may be arranged with only one of the openings in each pair of adjacent connectors being aligned. A barrier and methods of assembling a barrier system are also provided.

19 Claims, 4 Drawing Sheets

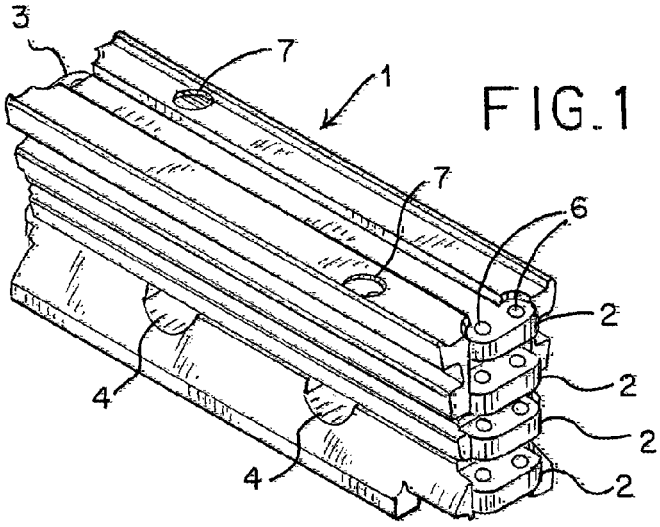
FIG. 1
FIG. 3
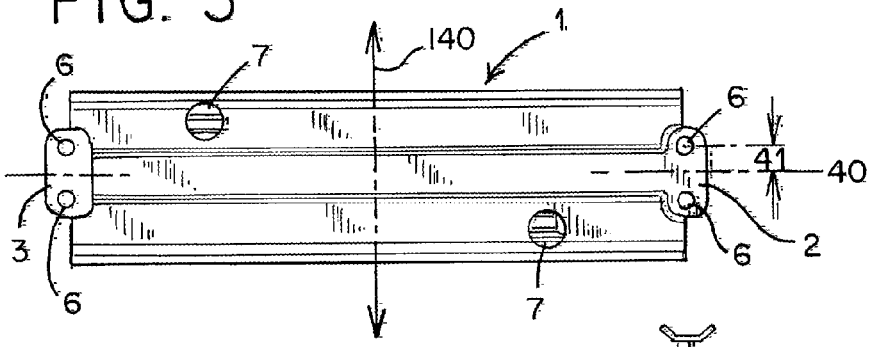
FIG. 2
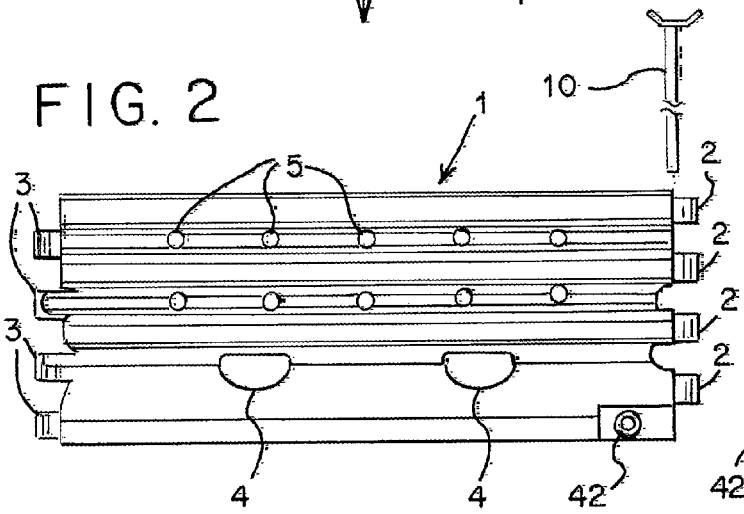
FIG. 4
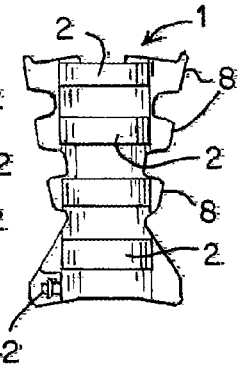

15
14
11
13
13
15

1
6
8
11
15
1
100
121

100
1
1
15

BARRIER SYSTEM AND CONNECTOR

This application claims the benefit of U.S. Provisional Application No. 61/791,675, filed Mar. 15, 2013, the entire disclosure of which is hereby incorporated herein by reference.

TECHNICAL FIELD

The present embodiments relate to barriers and barrier systems, and in particular to connections between such barriers.

BACKGROUND

Water filled barriers are commonly used on roadways as crashworthy protection devices. Although these barriers may be used to separate traffic and even in some instances to act as crashworthy end terminals to protect the ends of barriers, they are typically used as temporary barriers to protect workers in roadway work zones. Water filled barriers are well suited to this role as they are lightweight and easy to move when empty, making them easy to install quickly, without forklifts, cranes, or other heavy equipment.

In a typical work zone installation, the water filled barriers are offloaded from a transport truck and then placed end to end, allowing them to be pinned together. Some barrier designs have joints with a small amount of compliance, allowing the barriers to conform to curves in the roadway or to conform to the shape of the work zone. Once the barriers have been located and pinned together, a water truck drives from barrier to barrier and a road worker fills each barrier with water, giving it the necessary mass.

Crash testing is used to qualify the performance of water filled barriers before they are able to be used as protection devices. Typically a crash test standard, such as NCHRP 350, or MASH is used to determine the speeds and angles of the crash test vehicles. These test standards also contain pass/fail criteria and many governmental agencies allow the use of water filled barriers based on successfully passing crash tests called out by these standards.

The test standards also allow vehicles to be tested at various speeds, depending upon the anticipated use of the products being tested. For instance, a water filled barrier may be used in low speed applications, such as a parking garage, where it is unlikely to be impacted at greater than 50 kph (31 mph). Under the NCHRP 350 test standard, this speed would correspond to Test Level 1. Likewise, a water filled barrier may be used in a work zone inside the city limits, where posted speeds are closer to 70 kph (48 mph). Under the NCHRP 350 test standard, this speed would correspond to Test Level 2.

One measurement that is taken during the crash testing of water filled barriers is the maximum lateral deflection. This value provides a guideline as to how much room must be left behind the barrier in case of a lateral impact into the barrier. For instance, the Triton® Water filled Barrier, disclosed in U.S. Pat. No. 5,425,594 to Krage, the entire disclosure of which is hereby incorporated herein by reference, exhibited a deflection of 3.8 m (12.8 ft.) during a NCHRP 350 test. The deflection of the Triton barrier may be reduced or increased if impacted by vehicles with different weights, speeds, or impact angles. In addition to the parameters of the impact, listed above, the deflection of a water filled barrier is also dependent upon the design of the barrier itself.

The deflections listed above for the Triton Barrier may be sufficient for many applications, however there may be some work zones where lower values of deflection are desired.

Since one of the factors affecting the deflection of a water filled barrier is the stiffness of its joints, one way of reducing a water filled barrier's deflection is to increase the joint stiffness. For instance James in US 2010/0215427 discloses a barrier that uses two joining pins instead of one, stiffening the joint between the barriers significantly. James also discloses a method of decreasing the joint stiffness in key barriers by only engaging one of the pin holes in a barrier. This allows the barriers to follow a radius, for instance to follow a curve in the roadway. Although the James design provides a way of stiffening the barriers by providing two pins, both of these pins are located on the centerline of the barrier. This means that to provide increased joint stiffness, the pins would need to be spaced further apart, increasing the length of the joint. The pins of the James design also do not provide a way of ensuring a stiff joint when the joint is in a curved orientation.

SUMMARY

In one aspect, one embodiment of a barrier system includes a plurality of elongated barriers each having opposite, laterally spaced side impact surfaces and longitudinally spaced ends. Each of the ends is configured with a connector having a pair of laterally spaced openings. The barriers are arranged in an end-to-end configuration, wherein at least two adjacent barriers are arranged with both of the pairs of openings of adjacent connectors being aligned. A pair of connector pins extend through the pairs of aligned openings of the at least two adjacent barriers.

In one embodiment, at least two other adjacent barriers are arranged with only one of the openings in each pair of adjacent connectors being aligned. A single connector pin extends through the aligned openings of the at least two other adjacent barriers.

In one embodiment, a barrier includes an elongated shell structure having opposite, laterally spaced side impact surfaces and longitudinally spaced opposite ends. Each of the ends is configured with a connector having a pair of laterally spaced openings. A frame extends between the opposite ends of the shell, and includes a pair of eye structures formed at each end thereof. The eye structures define at least in part the pair of laterally spaced openings.

In another aspect, one embodiment of a method of assembling a barrier system includes providing a plurality of elongated barriers each having opposite, laterally spaced side impact surfaces and longitudinally spaced ends. Each of the ends is configured with a connector having a pair of laterally spaced openings. The method further includes arranging a first pair of barriers in a linear end-to-end configuration, wherein both of the pairs of openings of the adjacent connectors are aligned, and inserting a pair of first pins through the pairs of aligned openings. In one embodiment, the method further includes arranging a second pair of barriers in a non-linear end-to-end configuration, wherein one of the openings in each pair of adjacent connectors are aligned and wherein the other of the opening in each pair of adjacent connectors are misaligned. The method further includes inserting a second pin through the aligned openings of the second pair of barriers.

In one aspect of one embodiment a barrier is disclosed that has joints that allow the installation of at least two pins. The at least two pins are located a lateral distance from the center line of the axis of the barrier thereby rigidly holding the joint together so that the deflection of the barrier is minimized during a vehicle impact.

In another aspect, the two pins are held together as a single unit which eases their installation in the barriers, while also fixing the axial distance between the pins.

In yet another aspect, an internal frame for a water filled barrier is disclosed. The internal frame has individual frame eyes that individually enclose at least some of the pin holes. During assembly of the water filled barrier, the pins are placed in the pin holes. During a vehicle impact, a load path is created from barrier to barrier via the internal frame and the pins.

In yet another aspect, a water filled barrier is disclosed with a least two pin holes that are joined together by pins. The barrier is selectably configurable between a first in-line configuration, where the barriers are rigidly joined together in a straight line, a second curved configuration, where the barriers are rigidly joined together with an angle between each barrier, and a third variable configuration, where the barriers are flexibly joined together with an angle that is greater than or equal to zero (the straight configuration), up to and including the angle of the curved configuration. When the barriers are at their maximum angle relative to one another (i.e. in the curved configuration or in the flexible configuration with maximum angle) the top corners are touching and there is no gap between the barriers at this location.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

BRIEF DESCRIPTION OF THE DRAWINGS

FIG. 1 is a perspective view of a water filled barrier.

FIG. 2 is a side view of the water filled barrier of FIG. 1.

FIG. 3 is a top view of the water filled barrier of FIG. 1.

FIG. 4 is and end view of the water filled barrier of FIG. 1.

DETAILED DESCRIPTION OF THE PRESENTLY PREFERRED EMBODIMENTS

Figures 5, 6:
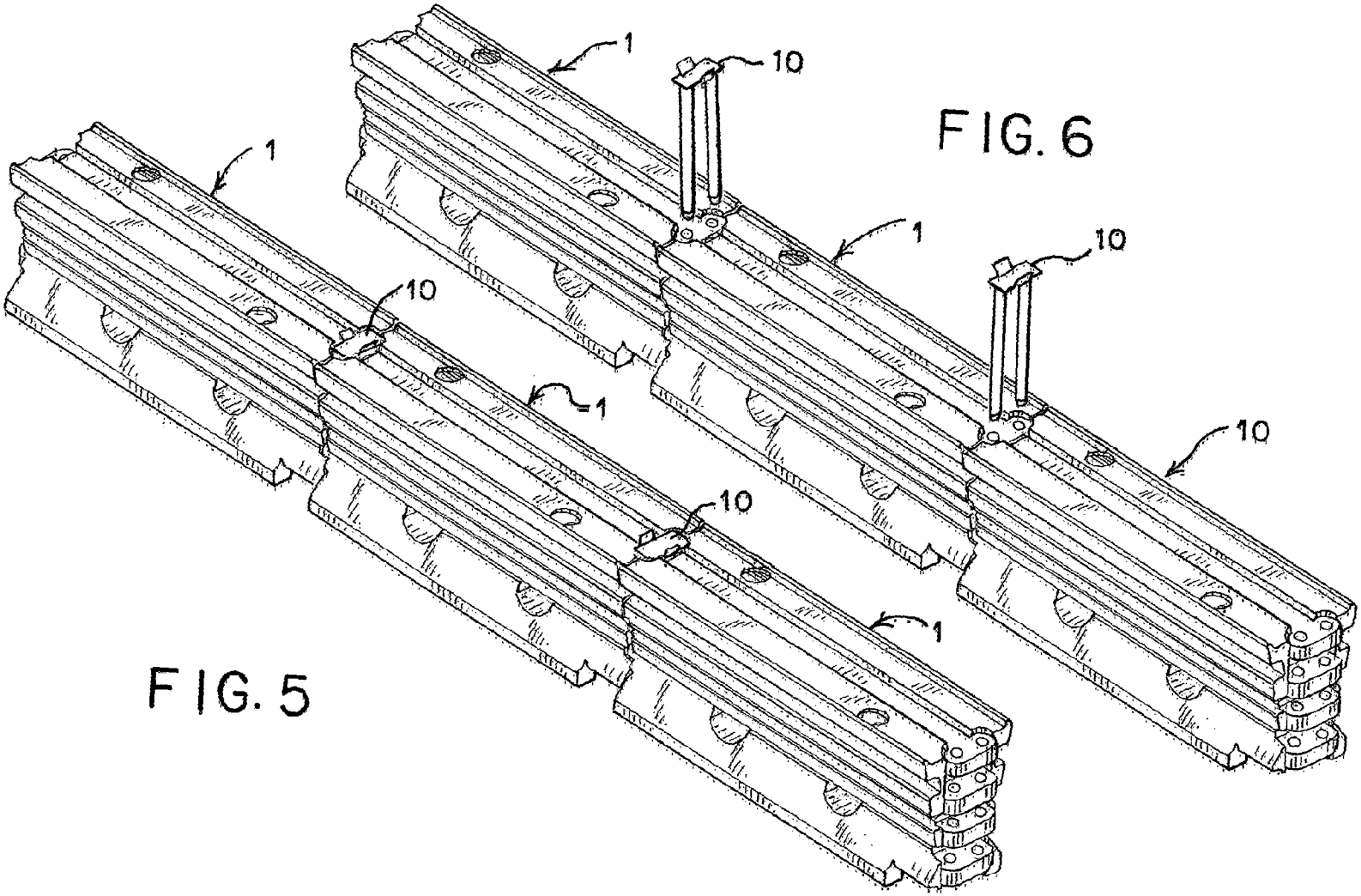
FIG. 5 is a perspective view of a line of water filled barriers which are joined together with pins.
FIG. 6 is a perspective view of a line of water filled barriers where the pins are shown removed from the barriers.

It should be understood that the term "longitudinal," as used herein means of or relating to length or the lengthwise direction of a barrier. The term "lateral," as used herein, means directed toward or running perpendicular to the length of the barrier, or from one side to the other of the barrier. The term "coupled" means connected to or engaged with, whether directly or indirectly, for example with an intervening member, and does not require the engagement to be fixed or permanent, although it may be fixed or permanent, and includes both mechanical and electrical connection. It should be understood that the use of numerical terms "first," "second" and "third" as used herein does not refer to any particular sequence or order of components; for example "first" and "second" barriers may refer to any sequence of such barriers, and is not limited to the first and second barriers unless otherwise specified. The term "plurality" means two or more, or more than one.

FIG. 1 is a perspective view of a new water filled barrier. Barrier 1 includes end connectors or locks 2 and 3, which include pin holes 6. Although FIG. 1 shows a total of 4 end locks 2 and 3 on each end of the barrier, different barrier designs may have more or less end locks 2 and 3, for instance three of each. Other designs may have different numbers on each end, for instance four end locks 2 and three end locks 3. The barrier includes an elongated shell extending in longitudinal direction 40, which may be filled with a fluid such as water, and a frame. The barrier has laterally spaced opposite impact side surfaces spaced apart in a lateral direction 140, and longitudinally spaced ends.

Fork lift ports 4 are provided for moving barrier, either when it is empty, or when it is full of water. Openings 7 are also provided to allow barrier 1 to be filled with water. Although openings 7 are shown uncovered in FIG. 1, it should be understood that they may also be covered to minimize the evaporation of water in barrier 1.

FIGS. 2, 3, and 4 are side, top, and end views of barrier 1. FIG. 2 shows how end connectors or locks 2 are separated vertically from end connectors or locks 3, allowing them to be interleaved on adjacent barriers 1. This allows holes 6 on adjacent barriers to also be aligned and the barriers can then be joined together with a suitable pin 10. Holes 6 of barrier 1 are offset some distance 41 from a centerline 40 of barrier 1. This allows the pins to apply a much larger resisting force to the rotation of the joints between barriers than if the holes 6 were placed on the centerline 40 of the barrier, which further defines a longitudinal direction or axis. Although two holes 6 are shown at each end of barrier 1, other designs may have more holes 6, for instance three, four, etc.

Also shown in FIG. 2 are through ports 5 which extend through the barrier from one side to the others. Through ports 5 have interior walls, so that although they provide a contiguous opening from one side of the barrier to the other, they are sealed from the interior volume of the barrier. This prevents the water in barrier 1 from leaking out of through ports 5. The fork lift ports 4 are of a similar design, with interior walls to ensure that the interior volume of barrier 1 is sealed. Fork lift ports 4 and through ports 5 help to transfer the loading of the barrier 1 from one wall to the other during a vehicle impact. This shared loading helps to prevent excessive deformation of barrier 1, which can lead to vehicle ramping and overriding over the top of the barrier 1. FIG. 4 shows ribs 8 which are formed in the sides of barrier 1. Ribs 8 increase the rigidity of barrier 1 to impacts, while also helping to guide impacting vehicles longitudinally down the barrier without ramping.

Drain port 42 is provided in some designs of barrier 1 to allow the barriers to be drained, once the barriers 1 are no longer needed to protect a section of roadway. Once the barriers 1 are drained they can easily be removed from the roadway and transported to a storage area.

FIG. 5 shows a series of three barriers 1 joined together with pin assemblies 10. FIG. 6 shows the same string of three barriers 1, except that pins 10 have been withdrawn. As can be seen in FIGS. 5 and 6, each barrier section is joined to the next barrier section with a two pronged pin assembly that rigidly locks the joints together.

Figures 7, 8, 9, 10:
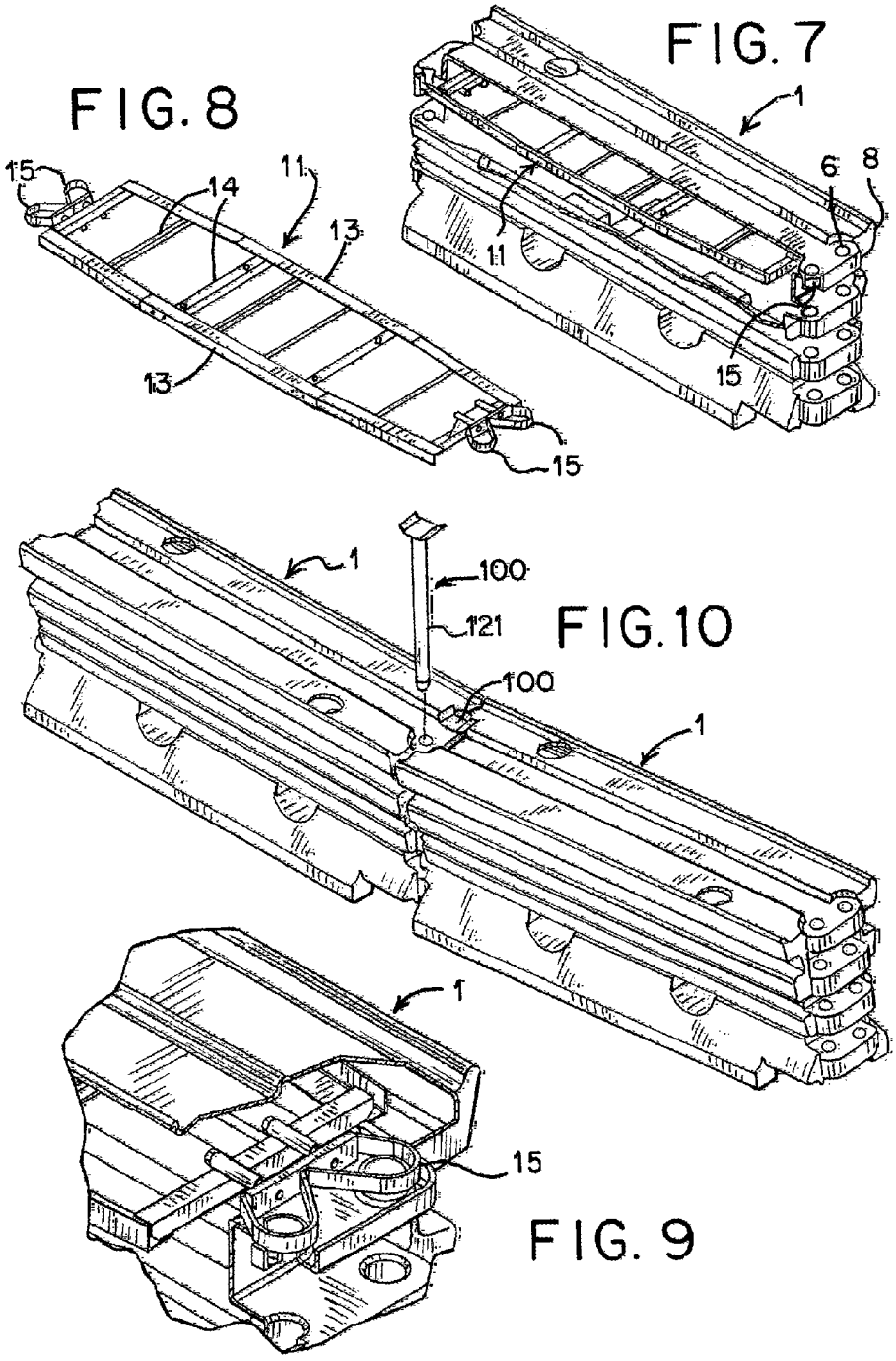
FIG. 7 is a perspective view of a water filled barrier where a portion of the outer wall is shown removed.
FIG. 8 is a perspective view of an internal frame used in a water filled barrier.
FIG. 9 is a partial perspective view of the end of a water filled barrier, where a portion of the outer wall is shown removed.
FIG. 10 is a perspective view of two water filled barrier segments in a flexible configuration, with one pin shown engaged and one pin shown removed.

FIG. 7 is a view of barrier 1 with a portion of the outer skin removed, so that the inner frame 11 is shown. As can be seen in FIG. 7, inner frame includes frame eye 15 which encloses pin hole 6. FIG. 7 also shows the location of frame 11 at the top of the barrier, enclosed by the upper most rib 8. Although in the embodiment shown in FIG. 11 the frame is enclosed by the top rib 8, it should be understood that in other designs, the frame may be located in a lower rib, in the area between ribs, or at the bottom of the barrier below the ribs.

FIG. 8 is a view of frame 11 shown without being enclosed by barrier 1. Frame 11 is composed of longitudinal members 13 and cross members 14. At each end of frame 11 there are two frames eyes 15 which enclose each of the pin holes 6.

FIG. 9 is an enlarged view of the end of barrier 1 with a portion of the outer skin removed. As can be seen in FIG. 9, frame eyes 15 enclose pin holes 6. Enclosing the pins holes 6 and in turn the pins 10 with the frame eyes 15 provides a load path from one barrier to the next during a vehicle impact. In this way the load is shared between barriers and the risk of an impacting vehicle breaking through a single barrier is minimized.

FIG. 10 is view of two barriers 1, being joined by pins 100 with outer diameters 121. One of pins 100 is shown removed in FIG. 10, which allows additional compliance in the joint between the barriers 1 allowing one of the barriers 1 to be rotated slightly from the other in a non-linear configuration. There may be some installations of barrier where this rotation is desirable, for instance to follow the curve of the roadway. In those locations where a straight run of barriers is desired both pins 100, or alternatively one of the pins 10 of FIGS. 5 and 6, could be installed with adjacent barriers arranged in a linear configuration. This installation would have relatively stiff joints and likewise relatively lower overall barrier deflection during a vehicle impact. Should a section of the barrier need to curve, for instance to follow the curve of the roadway, one of the pins 100 could be used in one of the holes, allowing more compliance in the joint. In a similar way, the barriers 1 could be designed to have enough compliance in the joints that pin 10 could be inserted in one set of the holes 6 in one barrier, however because of the relative angle between the barriers, the second leg of pin 10 would be placed in the holes 6 of one of the barriers, without engaging the holes 6 of the other barrier.

Figure 11:
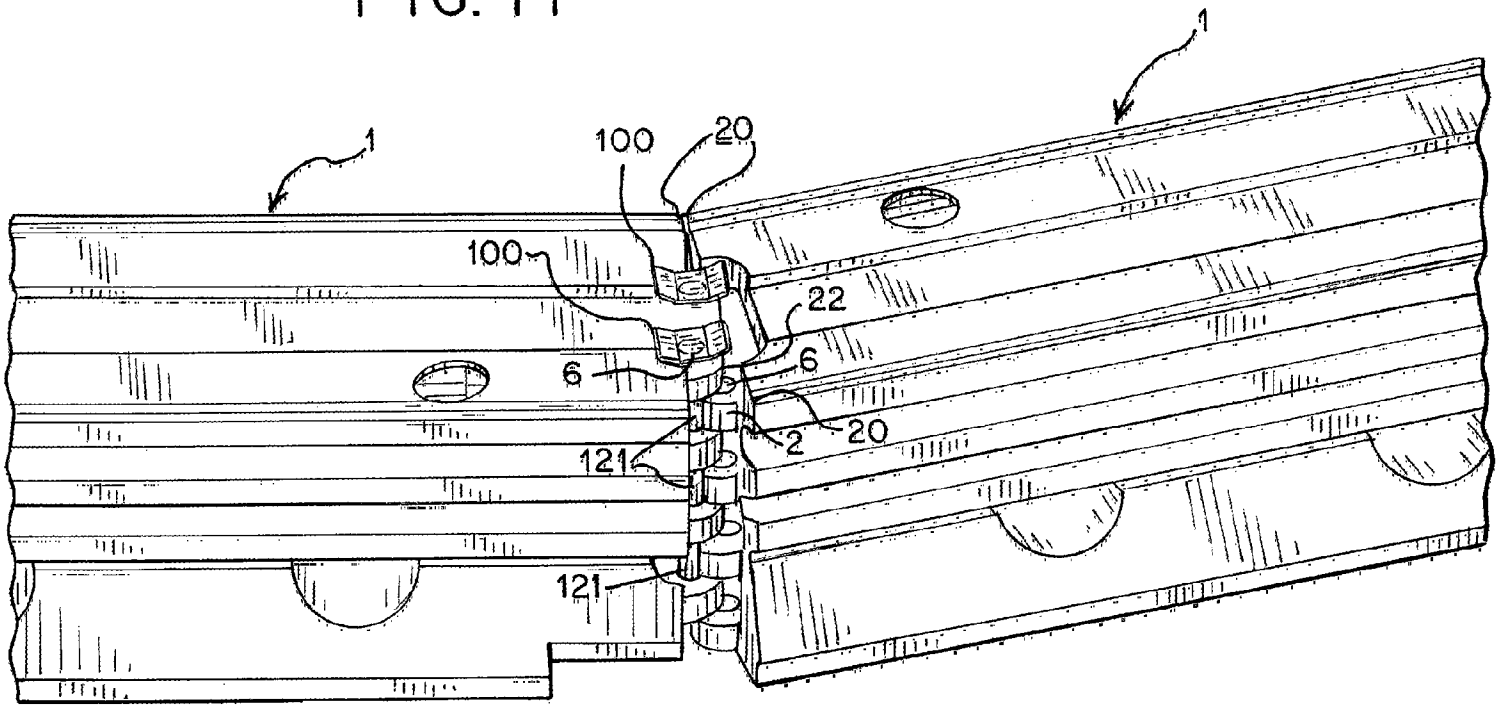
FIG. 11 is a partial perspective view of two water filled barrier segments in a curved configuration where one pin is engaged in pin holes in both barriers, but the other pin is only engaging the pin holes of one barrier.

FIG. 11 shows one such design. In FIG. 11, one of the pins 100 has joined two barriers together by going through the respective holes 6 in each of the barriers 1. The barriers 1 have then been rotated about the axis of pins 6 until the upper corners 20 of the barriers 1 are touching. Although the upper corners 20 of the barriers in FIG. 11 are shown as having an angle between them, other barrier designs could be created which have upper corners 20 that are parallel to each other when they touch.

The barrier design of FIG. 11 has enough compliance in the joint that the second pin 100 can be placed in the second set of pin holes 6 in the second barrier, without engaging the pin holes 6 of the first barrier. This design causes the outer surface 22 of end connector or lock 2 to come in contact with the outer surface 121 of pin 100. In this way the two barriers 1 are rigidly held via the contact of the outer surfaces at the touching upper corners 20, the contact between outer surface 22 and outer surface 121 on an opposite side of the pin, and the pin 100 in holes 6 between the two contacts. As such, the gap between the barriers on the inside of the curve (where the surfaces 20 are touching) is eliminated. Another advantage is that the joints of the barrier can be rigidly held in place, even with the barrier in a curved orientation.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A barrier system comprising:

a plurality of elongated barriers each comprising opposite, laterally spaced side impact surfaces and longitudinally spaced ends, wherein each of said ends is configured with a connector having a pair of laterally spaced openings, wherein said barriers are arranged in an end-to-end configuration, wherein at least two adjacent barriers are arranged with both of said pairs of openings of adjacent connectors being aligned, and wherein at least two other adjacent barriers are arranged with only one of said openings in each pair of adjacent connectors being aligned;

a pair of connector pins extending through said pairs of aligned openings of said at least two adjacent barriers, wherein said at least two adjacent barriers are arranged in a linear end to end configuration; and a single connector pin extending through said aligned openings of said at least two other adjacent barriers, wherein said at least two other adjacent barriers are arranged in a non-linear end to end configuration.

2. The barrier system of claim 1 wherein a second connector pin extends through one of said openings of one of said other adjacent barriers that are not aligned, wherein an outer surface of said connector of the other of said adjacent barriers engages said second connector pin.

3. The barrier system of claim 2 wherein an outer surface of said ends of said other adjacent barriers are in contact at a location positioned on an opposite side of said single connector pin relative to said second connector pin.

4. The barrier system of claim 2 wherein said single connector pin and said second connector pin are coupled together.

5. The barrier system of claim 1 wherein each of said barriers comprises a frame extending between said opposite ends of said barrier, wherein said frame comprises a pair of eye structures formed at each end thereof, wherein said eye structures define at least in part said pair of laterally spaced openings.

6. The barrier system of claim 5 wherein at least a portion of said frame is disposed in an interior of said shell.

7. A barrier comprising:

an elongated shell structure comprising opposite, laterally spaced side impact surfaces and longitudinally spaced opposite ends, wherein each of said ends is configured with a connector having a pair of laterally spaced openings, wherein each of said pairs of laterally spaced openings have an equal lateral spacing between said openings; and a frame extending between said opposite ends of said shell, wherein said frame comprises a pair of eye structures formed at each end thereof, wherein said eye structures define at least in part said pair of laterally spaced openings.

8. The barrier of claim 7 wherein said shell defines an interior cavity adapted to be filled with a fluid.

9. The barrier of claim 7 wherein at least a portion of said frame is disposed in an interior of said shell.

10. A method of assembling a barrier system comprising:

providing a plurality of elongated barriers each comprising opposite, laterally spaced side impact surfaces and longitudinally spaced ends, wherein each of said ends is configured with a connector having a pair of laterally spaced openings;

arranging a first pair of said barriers in a linear end-to-end configuration, wherein both of said pairs of openings of said adjacent connectors are aligned;

inserting a pair of first pins through said pairs of aligned openings;

arranging a second pair of barriers in a non-linear end-to-end configuration, wherein one of said openings in each pair of adjacent connectors are aligned and wherein the other of said opening in each pair of adjacent connectors are misaligned; and inserting a second pin through said aligned openings of said second pair of barriers.

11. The method of claim 10 further comprising inserting a third pin through one of said misaligned openings of one of said second pair of barriers, and engaging an outer surface of said connector of said other of said second pair of barriers with said third pin.

12. The method of claim 11 further comprising engaging outer surfaces of said ends of said second pair of barriers on an opposite side of said second pin from where said third pin is engaged with said connector.

13. The method of claim 11 wherein said second and third connector pins are coupled together.

14. A barrier system comprising:

a plurality of elongated barriers each comprising opposite, laterally spaced side impact surfaces and longitudinally spaced ends, wherein each of said ends is configured with a connector having a pair of laterally spaced openings, wherein said barriers are arranged in an end-to-end configuration forming linear or non-linear barrier formations, wherein at least two adjacent barriers are arranged with a plurality of aligned openings, wherein said at least two adjacent barriers form a linear barrier formation; and a pair of connector pins extending through said plurality of aligned openings of said at least two adjacent barriers.

15. The barrier system of claim 14 wherein said pair of connector pins are coupled together.

16. The barrier system of claim 14 wherein each of said barriers comprises a frame extending between said opposite ends of said barrier, wherein said frame comprises a pair of eye structures formed at each end thereof, wherein said eye structures define at least in part said pair of laterally spaced openings.

17. The barrier system of claim 6 wherein at least a portion of said frame is disposed in an interior of said shell.

18. A method of assembling a barrier system comprising:

providing a plurality of elongated barriers each comprising opposite, laterally spaced side impact surfaces and longitudinally spaced ends, wherein each of said ends is configured with a connector having a pair of laterally spaced openings;

arranging adjacent barriers in linear or non-linear formations including arranging a first pair of said barriers in a linear end-to-end configuration, wherein both of said pairs of openings of said adjacent connectors of said first pair of said barriers are aligned; and inserting a pair of pins through said aligned pairs of openings of said first pair of said barriers.

19. The method of claim 18 wherein said pair of pins are coupled together.

* * * * *